US006354645B2

(12) United States Patent
Bozlee

(10) Patent No.: US 6,354,645 B2
(45) Date of Patent: Mar. 12, 2002

(54) DEVICE AND METHOD FOR ADVERTISING AND CARRYING BAGS WITH HANDLES

(75) Inventor: Martin R. Bozlee, Oceanside, CA (US)

(73) Assignee: Grabb-It, Inc., Oceanside, CA (US)

( * ) Notice: Subject to any disclaimer, the term of this patent is extended or adjusted under 35 U.S.C. 154(b) by 0 days.

(21) Appl. No.: 09/752,990

(22) Filed: Jan. 2, 2001

Related U.S. Application Data

(60) Division of application No. 09/513,346, filed on Feb. 25, 2000, which is a continuation-in-part of application No. 29/103,360, filed on Apr. 13, 1999, now abandoned.

(51) Int. Cl.[7] ..... A45F 5/10
(52) U.S. Cl. ..... 294/171; 294/137
(58) Field of Search ..... 294/137, 141, 294/145, 147, 149–159, 165, 166, 170, 171; 16/114.1, 406, 422, 425, 428; 383/6, 13, 25; D9/434, 455

(56) References Cited

U.S. PATENT DOCUMENTS

| | | | | | |
|---|---|---|---|---|---|
| 1,691,467 | A | * | 11/1928 | Carver | 294/170 |
| 2,215,116 | A | * | 9/1940 | Crary | 294/171 |
| 4,262,385 | A | * | 4/1981 | Norman | 294/171 X |
| 4,796,940 | A | | 1/1989 | Rimland | 294/171 |
| 4,982,989 | A | * | 1/1991 | Sweeny | 294/171 |
| 5,005,891 | A | * | 4/1991 | Lunsford | 294/171 |
| 5,257,845 | A | * | 11/1993 | McConnell | 294/171 |
| 5,658,029 | A | * | 8/1997 | Franko | 294/171 |
| 5,803,522 | A | | 9/1998 | Lisbon | 294/171 |
| 5,865,494 | A | * | 2/1999 | Tipp | 294/171 |
| 5,881,432 | A | | 3/1999 | Good | 16/114 |
| 5,992,803 | A | | 11/1999 | LeRoux | 248/100 |
| 5,996,180 | A | | 12/1999 | Eisenzopf | 16/406 |

FOREIGN PATENT DOCUMENTS

| | | | | |
|---|---|---|---|---|
| DE | 3528037 | * | 2/1987 | 294/171 |
| DE | 3918355 | * | 12/1990 | 294/171 |
| EP | 85524 | * | 8/1993 | 294/171 |
| GB | 2241432 | * | 9/1991 | 294/171 |
| GB | 2255497 | * | 11/1992 | 294/137 |

* cited by examiner

*Primary Examiner*—Johnny D. Cherry
(74) *Attorney, Agent, or Firm*—Michael K. Dixon, Esq.; John S. Pratt, Esq.; Kilpatrick Stockton LLP

(57) ABSTRACT

The handle of the present invention is formed from a sheet of pliable material having a periphery with two opposed convex edges separated by two opposed concave edges. Two parallel fold-lines join the concave edges. When the sheet is folded, the body forms symmetrical walls that are fastened together using a tab, located on the edge of one symmetrical walls of the handle, and a groove formed on the edge of the second symmetrical wall of the handle, for receiving the tab. In its folded state, the handle resembles a taco shell with a bite taken from each end. The bite resemblance is formed by the two opposing concave edges and help to limit the length of the flat base formed by the space between the parallel fold lines. A correct base length allows the bag handles to naturally droop from the weight of the contents, so that the taut bag handles do not cut through the pliable body material or weaken the base. The design of the present invention allows for unobstructed advertisement on both outside surfaces of the handle as well as on both inside surfaces of the handle. Additionally, two separate entities can advertise on a single handle device. The present invention also solves the market penetration problem experienced with low margin grocers and other stores. Because advertising revenue is generated by the seller of the handles, the seller can penetrate the market by giving the handles away freely to grocers or other stores that use plastic bags.

17 Claims, 1 Drawing Sheet

DEVICE AND METHOD FOR ADVERTISING AND CARRYING BAGS WITH HANDLES

This application is a divisional of co-pending U.S. application Ser. No. 09/513,346, filed with the U.S. Patent Office on Feb. 25, 2000, which is a continuation-in-part of U.S. Design Application 29/103,360, filed with the U.S. Patent Office on Apr. 13, 1999, now abandoned.

This invention relates to devices for advertising and gripping bag handles to shield a person's hand when lifting and carrying the bag. More particularly, this invention relates to devices adapted to be installed on plastic bag handles, which present a medium for advertising.

BACKGROUND OF THE INVENTION

Bags are commonly provided to a purchaser of goods to carry the goods out of the retail establishment. In most grocery and department stores, plastic shopping bags are provided with carrying handles that are uncomfortable to grasp when the bags contain heavy articles. Plastic bags are fabricated from flexible plastic film and are formed so that a pair of plastic film webs are provided as handles, one on each side at the top of a bag opening. The plastic bags are very light, yet very strong, and do not break easily even when wet as do conventional paper bags. Therefore, the use of plastic bags in the grocery industry has become common place.

As a consequence of the strength of the plastic bags, many retail establishments such as grocery stores and supermarkets are able to load a significant amount of items in the bag. In addition, customers desire that the bags be loaded to reduce the number of bags necessary for carrying the contents as well as the number of trips necessary for transporting the contents into their homes. In carrying out these objectives, customers often carry more than one plastic bag at the same time in carrying the goods from the customer's automobile or bus to their destination. Unfortunately, in situations where the bag is heavily loaded, which is often, the bag handles become tightly drawn. Therefore, the handles become more like a string or wire which digs or cuts into the user's hand and fingers, and which can become painful after a fairly short period of time. Although the user could carry the load without fear of breakage and save a number of trips, there is discomfort to the user's hand making it difficult to carry the bag(s) for an appreciable distance.

In addition, when a person grasps the handles to lift the weighted bag, the person tends to make a closed fist that results in the fingers forming an approximately straight lifting channel about the bag handles. Consequently, the flexible handles, when the weighted bag is lifted, bear disproportionately against the outer sides of the person's index and pinkie fingers. The degree of discomfort imposed on the person lifting and carrying a weighted bag is sufficiently extreme that the bag cannot be filled to its capacity with articles that, in the aggregate, are too heavy. Clerks that fill these shopping bags know this and, therefore, often not only do not fill the bags to their capacity but, rather, significantly under-fill the bags. This results in the use of unnecessary bags, further reducing grocers already low profit margins.

Various attempts have been made to incorporate plastic handles into such shopping bags in an effort to distribute the load more evenly in a user's hand. One such attempt is disclosed in U.S. Pat. No. 5,803,522 to Lisbon. The Lisbon patent discloses a handle formed from a generally rectangular sheet of pliable material that can be tri-folded to form a handle. Lisbon fails to solve the problems created by plastic bag handles. For example, when the Lisbon handle is applied to a plastic bag it forms a handle with sharp edges. Consequently, when the consumer lifts the plastic bags using the Lisbon handle, the weight of the bags will cause the handle to move into a vertical position whereby the sharp edges will be positioned vertically. In this position, the sharp edges dig into the user's fingers and palm, causing extreme discomfort.

Various types of padding can be added to the bag handles, or the user can wear gloves. However, this can be costly, inconvenient, and may still cause discomfort in carrying the bags. Other types of hand grips have been proposed for solving the problems presented by plastic shopping bags. However, some such hand grips are cumbersome to apply and will not remain attached to the bag handles when the bag is set down, resulting in misplacement of the hand grip. These types of hand grips, may fall off the bag handles entirely, or become partially dislodged, necessitating their re-attachment when the bag is to be lifted again. Some handles once applied, are cumbersome to remove Since shopping bags are provided with two handles, on each side of a bag opening, when the two handles are brought together and confined by a hand grip device, access to the bag's interior is substantially reduced or eliminated until the hand grip is detached from one or both bag handles.

This is especially the case in U.S. Pat. No. 5,658,029 to Franko. Franko discloses a generally elliptical handle with asymmetrical adjacent walls. Franko attempts to eliminate the disadvantages associated with the Lisbon design by including a flat section for resting in the user's hand. However, the Franko design contains a locking mechanism that includes a tab with notched edges for insertion into a slot. A locking mechanism of this type makes it extremely cumbersome to disengage the handle. Furthermore, the pull through tab presents a pointed or sharp edge to the hand when the device is fully gripped. The locking mechanism in Franko also limits the amount of advertising surface available, obstructing the majority of usable surface area. Additionally, the Franko design contains an elongated flat surface where the plastic bag handles rest. The elongated flat surface must be of a length that allows the plastic bag handles to hang properly without placing undue tearing force on the surface. The elongated flat surface in Franko is created in such a fashion that the force of the bag handle pulling on the surface will cause it to weaken the protective surface. If the weight of the bag is great enough, the plastic material will cut through the pliable fiberboard or cardboard.

Hand grips that have been proposed are often cumbersome to store in a convenient manner where they must be applied by clerks. Additionally, the hand grips are too expensive to use in such common environments as the checkout stands of grocery stores, and similar kinds of stores where profit margins are relatively low. Store owners are reluctant to purchase the proposed hand grips because they cut into already low margins of profit.

Because of these deficiencies in the hand grips currently proposed, no hand grips are in wide use in the market, and virtually none of them are in use in low profit margin retail stores, such as grocery stores. It is difficult to sway grocers and other stores to purchase the handles.

SUMMARY OF THE INVENTION

This invention resolves the above-mentioned disadvantages. First, it overcomes the disadvantages of current handle grips in the market. Second, it provides a device for advertising that is cost effective and reaches a large audience. Third, it provides a method of business that resolves the issues surrounding the reluctance of store owners from purchasing the handle grips.

This handle is formed from a sheet of pliable material having a periphery with two opposed convex edges separated by two opposed concave edges. Two parallel fold-lines join the concave edges. When the sheet is folded, the body forms symmetrical walls that are fastened together using a tab, located on the edge of one symmetrical wall of the handle, and a groove formed on the edge of the second symmetrical wall of the handle, for receiving the tab. In its folded state, the handle resembles a taco shell with a bite taken from each end. The bite resemblance is formed by the two opposing concave edges and help to limit the length of the flat base formed by the space between the parallel fold lines. A correct base length allows the bag handles to naturally droop from the weight of the contents, so that the taut bag handles do not cut through the pliable body material or weaken the bottom handle section.

This design further allows for unobstructed advertisement on both outside surfaces of the handle as well as on both inside surfaces of the handle. For example, an advertisement for Pizza Hut can be placed on the outside surface of one side of the handle and a coupon for a dollar off a large pizza pie can be printed on the adjacent inner surface of the same side of the handle. The use of a coupon allows an advertiser to evaluate the effectiveness of its promotional campaign by measuring the number of coupons redeemed. Advertising can also be placed on the inside and outside surfaces of the base of the handle. Therefore, three separate entities can advertise on a single handle device.

This invention also solves the market penetration problem experienced with low margin grocers and other stores. Because advertising revenue is generated by the seller of the handles, the seller can penetrate the market by giving the handles away freely to grocers or other stores that use plastic bags or, in some instances, by paying retailers to distribute the handles. Therefore, the stores do not experience expenses that further reduce profit margins and are more likely to use the device.

Accordingly, the objects of this invention are as follows:

- to provide a gripping bag handle that protects the hands of a user carrying one or more heavily loaded plastic carrier bags;
- to provide a gripping bag handle that is durable and reliable in operation;
- to provide a gripping bag handle that locks the handles of a bag closed so that the contents of the bag does not fall out;
- to provide a gripping bag handle that can be quickly and easily incorporated for use with conventional plastic shopping bags;
- to provide a gripping bag handle that is simple and convenient in its use, yet cost-effective in its manufacture;
- to provide a medium for advertising that is cost effective and reaches a large audience;
- to provide a method of advertising that allows the advertiser to evaluate the effectiveness of the advertisement campaign; and
- to provide a method of business allowing the distributor of the handle apparatus to sell advertising space on the handle and freely give the apparatus to retailers or pay them to use it.

Further objects and advantages will become apparent from the following description, the accompanying drawings and the claims.

DETAILED DESCRIPTION OF THE DRAWINGS

Figure 1:
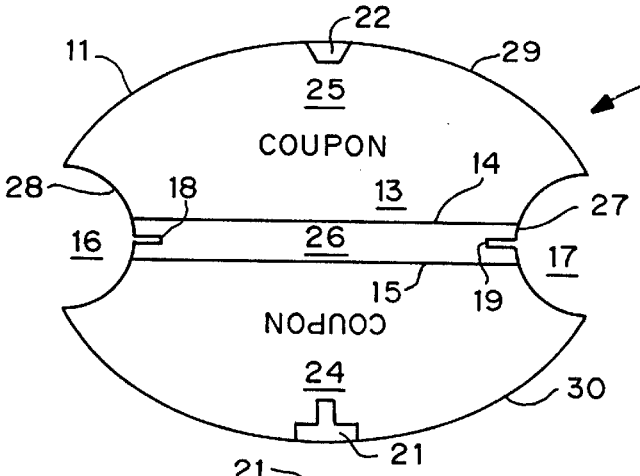
FIG. 1 is a plan view of one side of an exemplary handle of this invention.

Handle 10 is formed from a die-cut blank 11. Blank 11 is die cut from a flat semi-rigid sheet of material, for example, cardboard, fiberboard, paperboard, STYROFOAM (an expanded cellular polystyrene) or plastic. Blank 11 has a front surface 13 and a back surface 12 (shown in FIG. 2). Front surface 13 contains two parallel fold-lines 14 and 15 running the length of blank 11. Blank 11 also has two semicircular apertures 16 and 17 located at the length of blank 11. Blank 11 also has two semicircular apertures 16 and 17 located at each end 27 and 28 of blank 11. The thickness of blank 11 is chosen to permit the handle 10 to resist tearing during use, while allowing symmetrical walls 24 and 25 to be folded along score-lines 14 and 15. Back surface 12 and front surface 13 of blank 11 can be either smooth or contain waffling providing additional strength to the overall handle 10.

Figure 2:
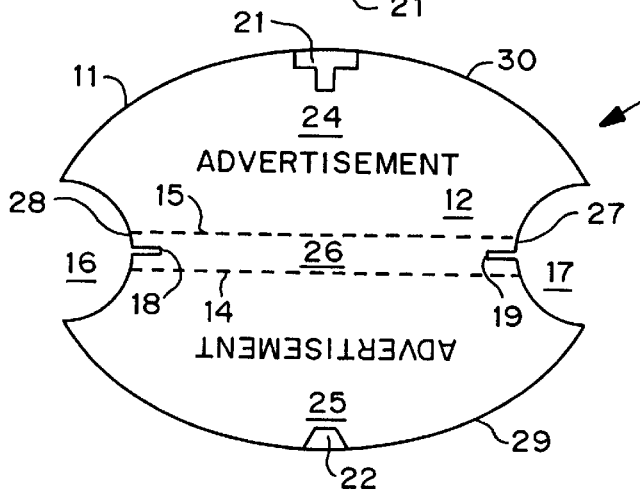
FIG. 2 is a plan view of the other side of the handle shown in FIG. 1.

Additionally, two cutout grooves 18 and 19 are located at the apex of each semicircular aperture 16 and 17, perpendicular to the edge and parallel to fold-lines 14 and 15. Blank 11 also has an edge 29 and an opposite edge 30. A small tab 21 is integrally cut into edge 30 of blank 11 in the shape of a "T," as shown in FIGS. 1 and 2. A groove 22 cut into edge 29 is also integrally formed in blank 11 during the die cutting process.

Figure 3:
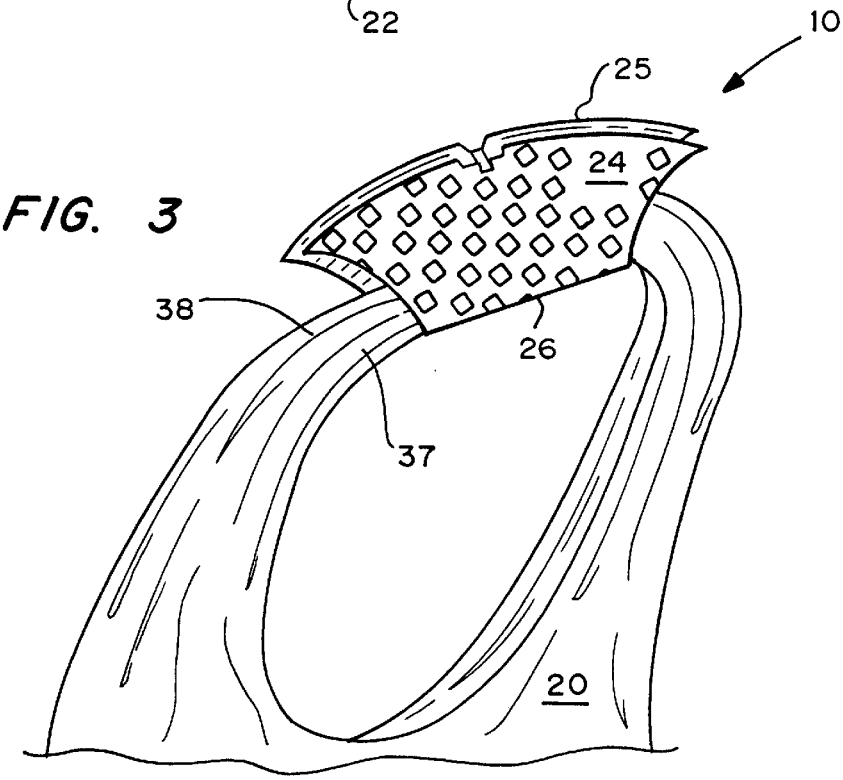
FIG. 3 is a perspective view of the handle of FIG. 1, in use on a plastic shopping bag.

Fold-lines 14 and 15 allow blank 11 to form a shape like a taco shell. When blank 11 is folded along fold-lines 14 and 15, two vertically extending symmetrical walls 24 and 25 are formed and are connected to a base 26, as disclosed in FIG. 3. Apertures 16 and 17 allow handle 10 to be formed with a properly sized base 26. When blank 11 is folded, forming the gripping handle 10 (FIG. 3), apertures 16 and 17 allow handle 10 to be formed with large unobstructed wall space while maintaining a proper base 26 length.

Base 26 must also be an appropriate length to allow bag handles 37 and 38 to hang naturally without putting too much pulling pressure on end 27 and 28 of handle 10. If the pulling pressure on end 27 and 28 is too high, the bag handles will tear or weaken end 27 and 28 causing base 26 to collapse. If base 26 collapses, generally it will collapse in the longitundinal direction forming a sharp edge along the length of base 26. The sharp edge formed from an incorrect base length defeats one of the objectives of handle 10, providing a comfortable device for carrying heavy bags containing handles.

Grooves 18 and 19 can be formed in base 26 for allowing bag handles 27 and 28 to properly hang in a natural state. Grooves 18 and 19 also serve to hold handle 10 in place by causing bag handles 27 and 28 to lodge into grooves 18 and 19. Therefore, in the event that the locking mechanism should fail, causing handle 10 to open, handle 10 will not fall off bag handles 27 and 28. However, grooves 18 and 19 are not imperative for carrying out the objectives of the invention; they merely add additional functionality.

Still referring to FIGS. 1 and 2, a locking mechanism is integrally formed in blank 11 during the die cutting process. Tab 21 and groove 22, for receiving tab 21, are formed in the outer edges of blank 11. In applying handle 10 to bag 20 or a group of bags, tab 21 on wall 24 is bent over wall 25, locking tab 21 into groove 22 in wall 25. The location of tab 21 and groove 22 are limited to the outer edges of blank 11 to retain the maximum unobstructed surface space on symmetrical walls 24 and 25. Unobstructed surface space on symmetrical walls 24 and 25 is important.

Handle 10 has two walls 24 and 25 that are hardly obstructed. The distributor of handle 10 can sell the space for advertising. For example, bottom surface 12 of wall 24 can be sold to advertise for Pizza Hut. Top surface 13 of wall 24 can include a coupon for a pizza from Pizza Hut. Additionally, bottom surface 12 of wall 25 can be used to advertise for Speedee Oil Service and a coupon for an oil change can be included on top surface 13 of wall 25. Selling advertisement space on handle 10 allows the distributor of handle 10 to generate revenues, while distributing handle 10 to store owners for free, or in some instances, by paying store owners to distribute handle 10.

The foregoing is provided for purposes of illustrating, explaining, and describing embodiments of the present invention, a device for advertising that allows a shopper to carry heavy bags, containing handles, with no discomfort. Modifications and adaptations to these embodiments will be apparent to those skilled in the art and may be made without departing from the spirit of the invention or the scope of the following claims. For example, handle 10 can be formed from many types of materials such as plastics, fiberboard, or Styrofoam. Additionally, handle 10 can be made in many shapes. For example, the blank can be round, square, diamond or hexagonal shaped. Furthermore, other types of locking tabs can be used. The locking tab can be in the shape of a half-moon or triangle. Alternately, the locking mechanism can take the form of different types of glues. The key aspect of the locking mechanism is that it be placed in a location that provides the most unobstructed advertising space on handle 10.

What is claimed is:

1. A device for advertising and for forming a handle grip, comprising:

a. a blank of pliable material having a top surface, a bottom surface and a periphery comprising a first convex edge, a second convex edge, a first concave edge and a second concave edge, wherein the first and second convex edges are separated by the first and second concave edges and wherein the first and second convex edges are symmetrical and the first and second concave edges are symmetrical;

b. two integrally formed, parallel fold-lines joining the first and second concave edges, wherein a first wall, a second wall and a base are formed when the blank is folded along the two integrally formed, parallel fold-lines, wherein the first wall and the second wall are symmetrical;

c. a tab formed on the first convex edge on the first wall;

d. a groove formed on the second convex edge on the second wall for receiving the tab;

e. wherein the tab is cut out of the convex edge of the first wall and further comprises:

a first rectangular member positioned generally orthogonal to the fold-lines and attached at one end to the first wall; and a second rectangular member positioned generally parallel to the fold-lines and attached to the first member so that an outer edge of the second member is flush with the first convex edge of the first wall; and f. wherein the groove is cut out of the second convex edge of the second wall and further comprises:

a first groove side, a second groove side and an opening, wherein the opening is positioned at the second convex edge, wherein the first and second groove sides extend into the second wall and wherein the first and second groove sides are positioned relative to each other such that at the opening, the first and second groove sides are closer to each other than at any location within the second side.

2. The device of claim 1, further comprising a first rectangular groove cut in the first concave edge, parallel to the fold lines, and a second rectangular groove cut into the second concave edge, parallel to the fold lines, for receiving bag handles.

3. The device of claim 1, further comprising a first region along the top surface adjacent to the first convex edge containing a first layer of pressure sensitive glue and a second region along the top surface adjacent to the second convex edge containing a second layer of pressure sensitive glue, wherein the first wall is coupled to the second wall by squeezing the two walls together such that the first and second layer of pressure sensitive glue contact each other.

4. The device of claim 1, wherein the top surface further comprises advertisements.

5. The device of claim 1, wherein the top surface further comprises coupons.

6. The device of claim 1, wherein the bottom surface further comprises advertisements.

7. The device of claim 1, wherein the bottom surface further comprises coupons.

8. The device of claim 1, wherein the bottom surface further comprises advertisements.

9. The device of claim 1, wherein the pliable material is a material selected from the group consisting of cardboard, fiberboard, paperboard, expanded cellular polystyrene, and plastic.

10. A method of installing a device for advertising and forming a handle grip, comprising:

a. positioning beneath the handles of a bag a device for advertising and for forming a handle grip, comprising:

a blank of pliable material having a top surface, a bottom surface and a periphery comprising a first convex edge, a second convex edge, a first concave edge and a second concave edge, wherein the first and second convex edges are separated by the first and second concave edges and wherein the first and second convex edges are symmetrical and the first and second concave edges are symmetrical;

two integrally formed, parallel fold-lines joining the first and second concave edges, wherein a first wall, a second wall and a base are formed when the blank is folded along the two integrally formed, parallel fold-lines, wherein the first wall and the second wall are symmetrical;

a tab formed on the first convex edge on the first wall;

a groove formed on the second convex edge on the second wall for receiving the tab;

wherein the tab is cut out of the convex edge of the first wall and further comprises:

a first rectangular member positioned generally orthogonal to the fold-lines and attached at one end to the first wall; and a second rectangular member positioned generally parallel to the fold-lines and attached to the first member so that an outer edge of the second member is_ flush with the first convex edge of the first wall; and wherein the groove is cut out of the second convex edge of the second wall and further comprises:

a first groove side, a second groove side and an opening, wherein the opening is positioned at the second convex edge, wherein the first and second groove sides extend into the second wall and wherein the first and second groove sides are positioned relative to each other such that at the opening, the first and second groove sides are closer to each other than at any location within the second side;

b. folding the pliable material along the fold lines forming the first wall and the second wall connected by the base, wherein the bag handles rest on the base; and c. coupling the first wall to the second wall by folding and fastening the tab on the first wall into the groove formed in the second wall.

11. The method of claim 10, wherein the device for advertising and for forming a handle grip further includes a first region along the top surface adjacent to the first convex edge containing a first layer of pressure sensitive glue and a second region along the top surface adjacent to the second convex edge containing a second layer of pressure sensitive glue, and wherein coupling the first and second walls further comprises squeezing the edge of the first wall against the opposite edge of the second wall, such that a layer of glue coupled to each opposite edge contacts each other.

12. The method of claim 10, wherein the top surface further comprises advertisements.

13. The method of claim 10, wherein the top surface further comprises coupons.

14. The method of claim 10, wherein the bottom surface further comprises advertisements.

15. The method of claim 10, wherein the bottom surface further comprises coupons.

16. The method of claim 10, wherein the bottom surface further comprises advertisements.

17. The method of claim 10, wherein the pliable material is a material selected from the group consisting of cardboard, fiberboard, paperboard, expanded cellular polystyrene, and plastic.

* * * * *